US009892903B1

(12) United States Patent
Canterbury

(10) Patent No.: US 9,892,903 B1
(45) Date of Patent: Feb. 13, 2018

(54) SYSTEMS AND METHODS FOR COUPLING A LASER BEAM TO A MASS SPECTROMETER

(71) Applicant: Thermo Finnigan LLC, San Jose, CA (US)

(72) Inventor: Jesse D. Canterbury, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/389,377

(22) Filed: Dec. 22, 2016

(51) Int. Cl.
*H01J 49/00* (2006.01)
*H01J 49/42* (2006.01)
*H01J 49/06* (2006.01)

(52) U.S. Cl.
CPC ..... *H01J 49/427* (2013.01); *H01J 49/061* (2013.01)

(58) Field of Classification Search
CPC ..... H01J 49/00; H01J 49/02; H01J 49/041; H01J 49/0463; H01J 49/10; H01J 49/16; H01J 49/161; H01J 49/162; H01J 49/164; H01J 49/427
USPC ..... 250/281, 282, 283, 288, 284
See application file for complete search history.

(56) References Cited

U.S. PATENT DOCUMENTS

2005/0157763 A1* 7/2005 Tan ..... G02F 1/113 372/26
2009/0242753 A1* 10/2009 Dogourd ..... G01N 27/64 250/283

OTHER PUBLICATIONS

Kino et al., "Confocal Scanning Optical Microscopy and Related Imaging Systems", Chapter 1, Academic Press, 1996, pp. 1-66.
Kino et al., "Confocal Scanning Optical Microscopy and Related Imaging Systems", Chapter 2, Academic Press, 1996, pp. 67-145.
Wu et al., "Electric-field-induced second-harmonic microscopy", phys. stat. sol. (c) 0, No. 8, (2003), pp. 3081-3085.
Zavalin, et al., "Implementation of a Gaussian Beam Laser and Aspheric Optics for High Spatial Resolution MALDI Imaging MS", J. Am. Soc. Mass Spectrom. (2014), vol. 25 (6), pp. 1079-1082.

* cited by examiner

*Primary Examiner* — Jason McCormack
(74) *Attorney, Agent, or Firm* — David A. Schell

(57) ABSTRACT

A mass spectrometry system includes a laser source, a trapping volume, first and second beam deflectors, and a deflector controller. The first and second beam deflectors are arranged on a path from the laser source to the trapping volume. The first beam deflector is configured to oscillate in a first direction at a first frequency and the second beam deflector configured to oscillate in a second direction orthogonal to the first direction at a second frequency. The deflector controller is configured to scan a scanned area within the trapping volume with the laser by controlling the oscillation of the first and second beam deflectors to cause ions trapped within the trapping volume to fragment into fragment ions. The scanned area has a first dimension defined by the oscillation in first direction and a second dimension defined by the oscillation in the second direction.

19 Claims, 8 Drawing Sheets

SYSTEMS AND METHODS FOR COUPLING A LASER BEAM TO A MASS SPECTROMETER

FIELD

The present disclosure generally relates to the field of mass spectrometry including coupling a laser beam to a mass spectrometer.

INTRODUCTION

Mass spectrometry is an analytical chemistry technique that can identify the amount and type of chemicals present in a sample by measuring the mass-to-charge ratio and abundance of gas-phase ions. Laser light can be used to induce fragmentation of the gas-phase ions to provide additional information about the ions, such as structural information.

When laser light is used for mass spectrometry experiments, alignment of the laser beam with both the ionizing chamber and critically with the ion cloud can be a significant and recurring problem. Static optical mounting hardware is often used, and the beam is aligned at instrument installation. Inevitably, thermal cycling, mechanical vibrations, or other disturbances lead to beam misalignment, which must then be corrected in the field, resulting in costs and lost time. Additionally, experience shows that adequate alignment is difficult even for personnel trained in both optical hardware and mass spectrometry, and sometimes even requires the "magic" of a seasoned expert.

As such, there is a need for new systems and methods for coupling a laser beam to a mass spectrometer.

SUMMARY

In a first aspect, a mass spectrometry system can include a laser source, a trapping volume, first and second beam deflectors, and a deflector controller. The first and second beam deflectors can be arranged on a path from the laser source to the trapping volume. The first beam deflector can be configured to oscillate in a first direction at a first frequency and the second beam deflector can be configured to oscillate in a second direction orthogonal to the first direction at a second frequency. The deflector controller can be configured to scan a scanned area within the trapping volume with the laser by controlling the oscillation of the first and second beam deflectors, causing ions trapped within the trapping volume to become excited. The excited ions can fragment into fragment ions. The scanned area can have a first dimension defined by the oscillation in first direction and a second dimension defined by the oscillation in the second direction.

In various embodiments of the first aspect, the first and second beam deflectors can be mirror galvanometers.

In various embodiments of the first aspect, the first and second beam deflectors can be acousto-optic modulators.

In various embodiments of the first aspect, the second frequency can be a multiple of the first frequency. In particular embodiments, the multiple can be an integer multiple. In particular embodiments, the second frequency can be not less than the first frequency times the ratio of the first dimension to a beam width.

In various embodiments of the first aspect, the laser source can be a pulsed laser source with a pulse frequency higher than the second frequency. In particular embodiments, the pulse frequency can be not less than the second frequency times the ratio of the second dimension to a beam width.

In various embodiments of the first aspect, the mass spectrometry system can further include an ion source for producing the ions and ion optics for moving the ions from the ion source to the trapping volume.

In various embodiments of the first aspect, the mass spectrometry system can further include a mass analyzer configured to determine the mass to charge ratio of the ions in the trapping volume.

In a second aspect, a method of analyzing ions can include trapping ions within a trapping volume, sweeping an area of the trapping volume with a laser by oscillating first and second beam deflectors to excite the trapped ions, fragmenting the excited ions within the trapping volume to produce ion fragments, and determining a mass-to-charge ratio for the ion fragments. The first beam deflector can be configured to oscillate in a first direction at a first frequency and the second beam deflector can be configured to oscillate in a second direction orthogonal to the first direction at a second frequency;

In various embodiments of the second aspect, the first and second beam deflectors can be mirror galvanometers.

In various embodiments of the second aspect, the first and second beam deflectors can be acousto-optic modulators.

In various embodiments of the second aspect, the second frequency can be a multiple of the first frequency. In particular embodiments, the multiple can be an integer multiple. In particular embodiments, the second frequency can be not less than the first frequency times the ratio of the first dimension to a beam width.

In various embodiments of the second aspect, the laser can be a pulsed laser with a pulse frequency higher than the second frequency. In particular embodiments, the pulse frequency can be not less than the second frequency times the ratio of the second dimension to a beam width.

In various embodiments of the second aspect, the method can further include producing ions from a sample in an ion source, and guiding the ions from the ion source to the trapping volume using ion optics.

DRAWINGS

For a more complete understanding of the principles disclosed herein, and the advantages thereof, reference is now made to the following descriptions taken in conjunction with the accompanying drawings and exhibits, in which.

Figure 1:
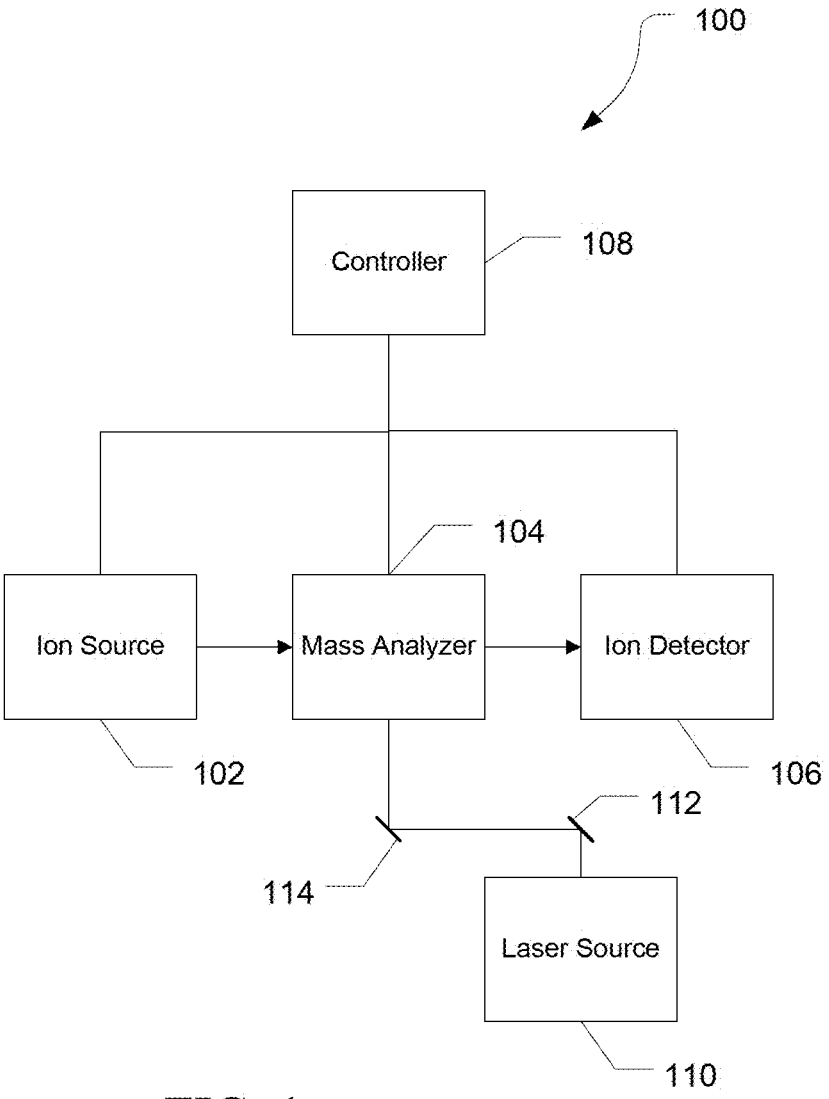
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion analysis are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, a controller 108, and a laser source 110.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), ultraviolet photo dissociation (UVPD), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, an image charge detection scheme, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

In various embodiments, the laser source 110 can generate a continuous or pulsed laser beam that can be directed to interact with ions with in the mass analyzer 104, such as ions trapped in an ion trap for photo induced dissociation. Alignment of the laser beam with the ion trapping space within the ion trap can be accomplished using various beam deflectors 112 and 114.

Laser Alignment

Figure 2:
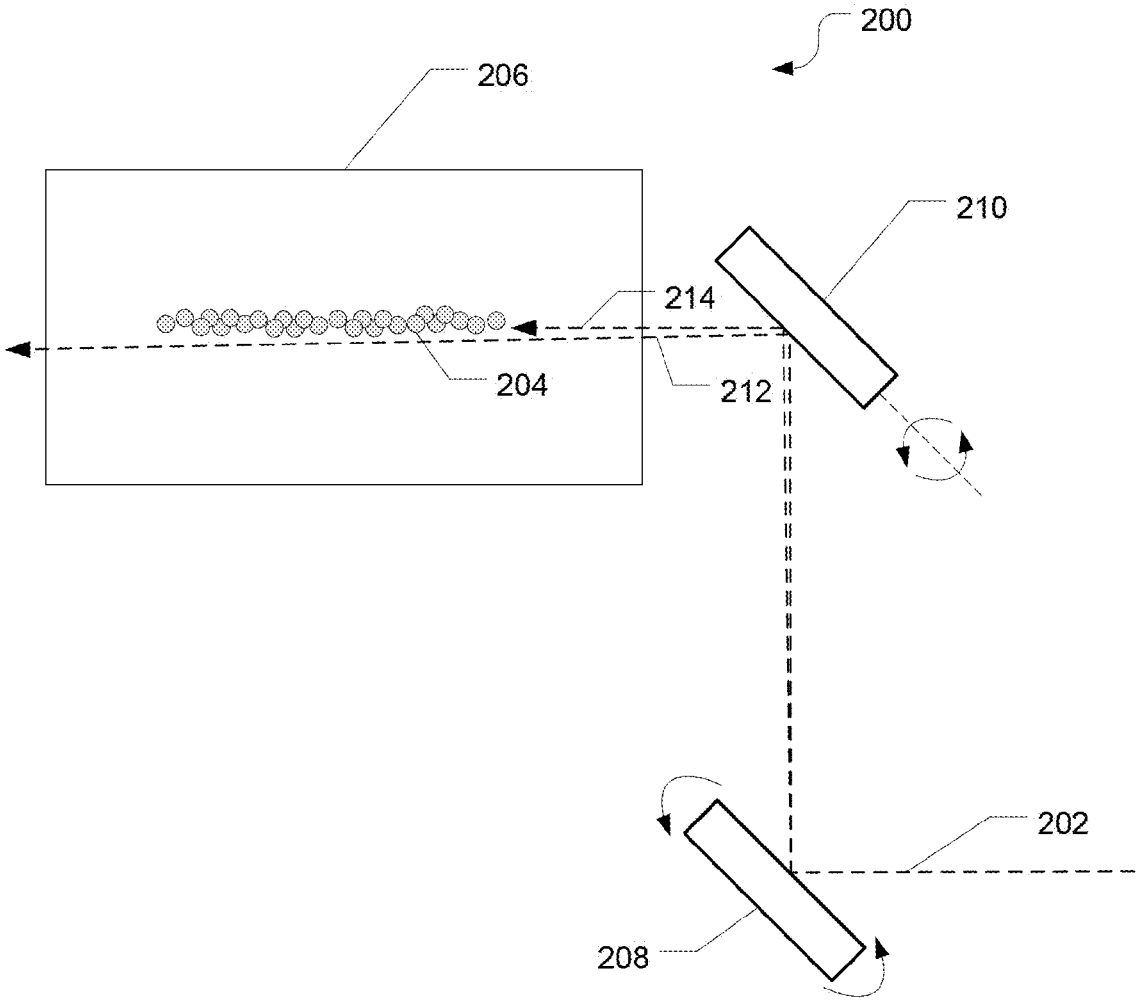
FIG. 2 is a diagram illustrating alignment of a laser to an ion cloud in an ion trapping volume within an exemplary mass spectrometer, in accordance with various embodiments.

FIG. 2 is a diagram 200 illustrating alignment of a laser beam 202 to an ion cloud 204 in an ion trapping volume 206. Laser beam 202 can be directed to the ion trapping volume 206 using beam deflectors 208 and 210. Movement of one or more of beam deflectors 208 and 210 can alter the path of laser beam 202 from a misaligned path 212 to an aligned path 214. Misalignment of laser beam 202 can result in laser beam 202 missing a significant portion of ion cloud 204. Alternatively, with the aligned path 214, a significant portion of the ions of the ion cloud 204 can interact with laser beam 202, which can result in excitation and possible fragmentation of the ions.

In various embodiments, beam deflectors 208 and 210 can be electronically controlled to manipulate the beam path, allowing electronic feedback that can be used to automate or even eliminate the alignment process. In various embodiments, beam deflectors 208 and 210 can be mirror galvanometers, acousto-optic modulators (shown in FIG. 3.), or combination thereof. Mirror galvanometers can deflect the laser beam in response to an electric current.

Figure 3:
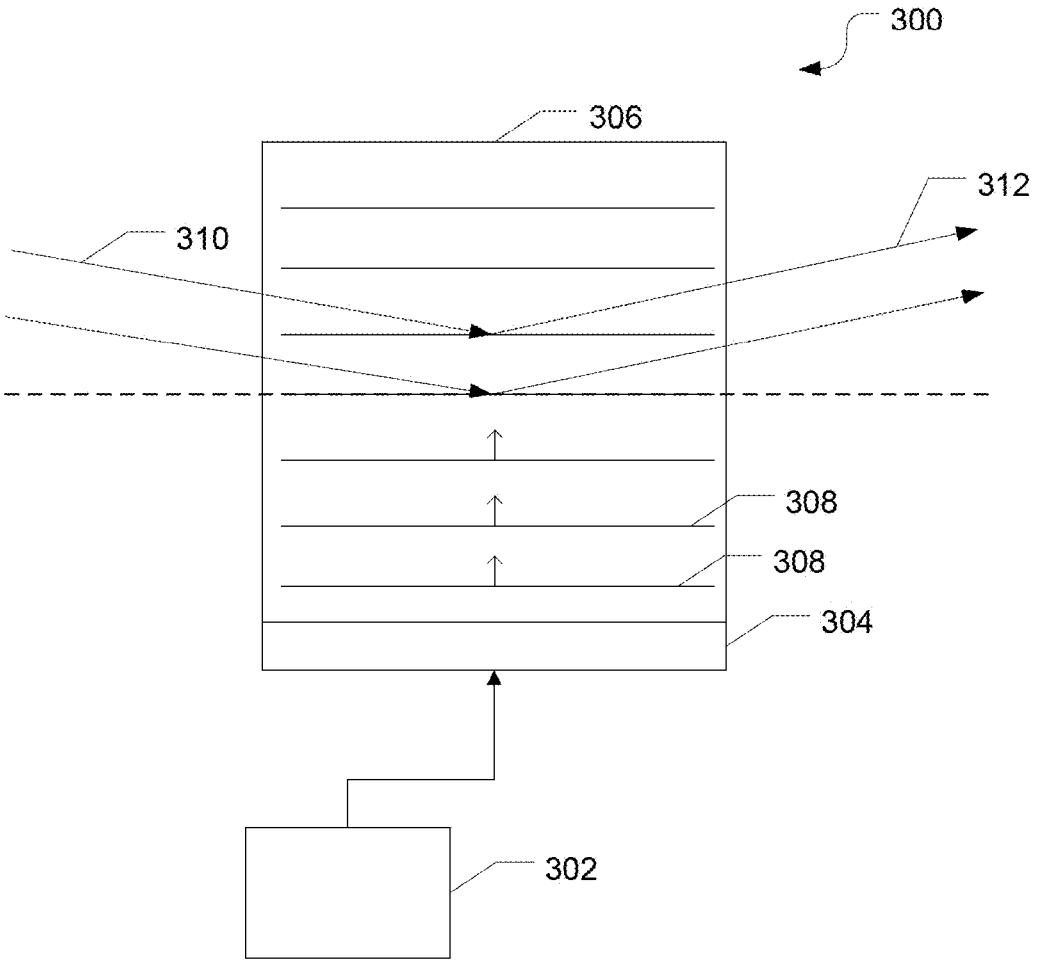
FIG. 3 is a drawing illustrating an alternate laser deflector for use in an exemplary mass spectrometer, in accordance with various embodiments.

FIG. 3 is a drawing illustrating the operation of an acousto-optic modulator. Acousto-optic modulators can use the acousto-optic effect to diffract the laser beam using sound waves (usually at radio-frequency). An RF modulator 302 drives a piezoelectric transducer 304 is attached to a material 306, such as glass. An RF signal can drive the transducer 304 to vibrate, creating sound waves in the material 306. Moving planes of expansion and compression 308 can change the index of refraction. Incoming photons 310 from the laser beam are refracted by the planes of expansion and compression 308 resulting in a deflected beam 312. Changing the frequency of the sound waves and thus the spacing between the planes of expansion and compression 308, changes the angle of deflection.

Laser Scanning

Figure 4A:
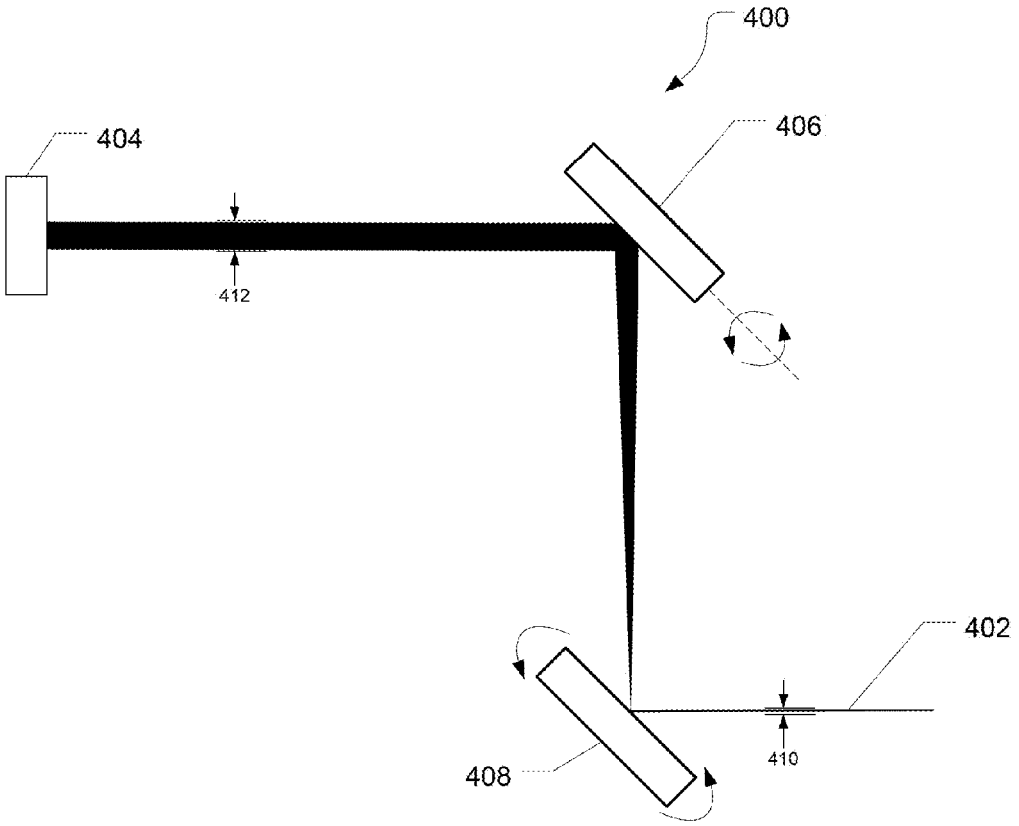
FIGS. 4A and 4B illustrate scanning a laser though an ion trapping volume within an exemplary mass spectrometer, in accordance with various embodiments.
Figure 4B:
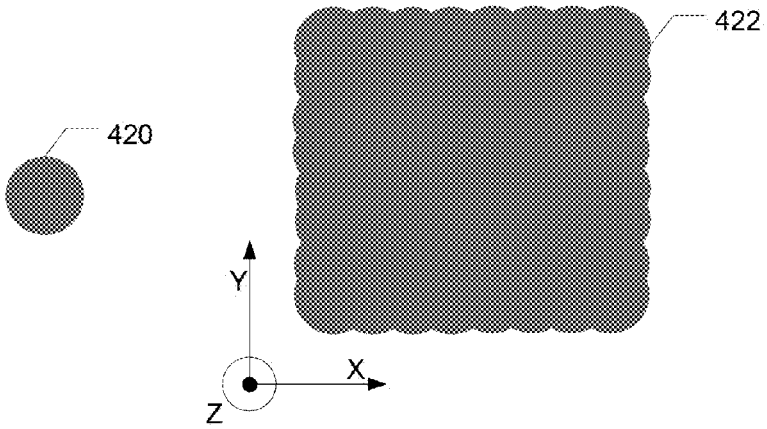

FIG. 4A illustrates an exemplary system 400 for scanning a laser beam 402 through an ion trapping volume 404. Beam deflectors 406 and 408 can be configured to oscillate in different directions relative to the beam axis Z. For example, beam deflector 406 can be configured to sweep the laser beam 402 back and forth along the X direction as depicted in FIG. 4B, and beam deflector 408 can be configured to sweep the laser beam 402 along the Y direction. By appropriately setting the oscillation frequency for beam deflectors 406 and 408, an area larger than the beam width can be targeted, as illustrated in FIG. 4B. Beam image 420 can represent the cross section of the laser beam 402, such as with stationary mirrors or at point 410 of FIG. 4A, and beam image 422 can represent the cross section of laser beam 402 at point 412 of FIG. 4A. Beam image 422 is significantly larger than beam image 420 due to scanning of the beam in the X and Y dimensions.

In various embodiments, to effectively scan the target area, the oscillation frequency of beam deflector 406 and the oscillation frequency of beam deflector 408 need to be different. When the oscillation frequencies are the same, the beam image would correspond to a diagonal line. In various embodiments, the oscillation frequency of beam deflector 408 can be larger than the oscillation frequency of beam deflector 406, such as a multiple of the oscillation frequency of beam deflector 406. In particular embodiments, the oscillation frequency of beam deflector 408 can be an integer multiple of the oscillation frequency of beam deflector 406. By way of example, if the oscillation frequency of beam deflector 408 is eight times greater than the oscillation frequency of beam deflector 406, the beam will cross the Y dimension eight times for each pass along the X dimension. This can enable a sweep area that is up to about eight times larger than the beam width along the X dimension. In particular embodiments, the oscillation frequency of beam deflector 408 can be not less than the oscillation frequency of beam deflector 406 times the ratio of the X dimension to the beam width, or more generally, the higher oscillation frequency can be not less than the lower oscillation frequency times the ratio of the first dimension to the beam width.

In various embodiments, the laser beam 402 can be a pulsed laser with a pulse frequency that is higher than the higher of the oscillation frequencies of beam deflector 406 and 408. By way of example, with the oscillation frequency of beam deflector 408 eight times greater than the oscillation frequency of beam deflector 406, if the pulse frequency of the laser is 8 times higher than the oscillation frequency of beam deflector 408, then there will be 8 pulses per pass of the Y dimension. This can enable a sweep area that is up to about eight times larger than the beam width along the Y dimension. The pulse frequency of laser beam 402 can be not less than the oscillation frequency of beam deflector 408 times the ratio of the Y dimension to the beam width, or more generally, the pulse frequency can be not less than the higher oscillation frequency times the ratio of the second dimension to the beam width.

In alternate embodiments, the beam deflector 406 can have a larger oscillation frequency than beam deflector 408 to achieve similar results, and the pulse frequency can be higher than the oscillation frequency of beam deflector 406.

Figure 5:
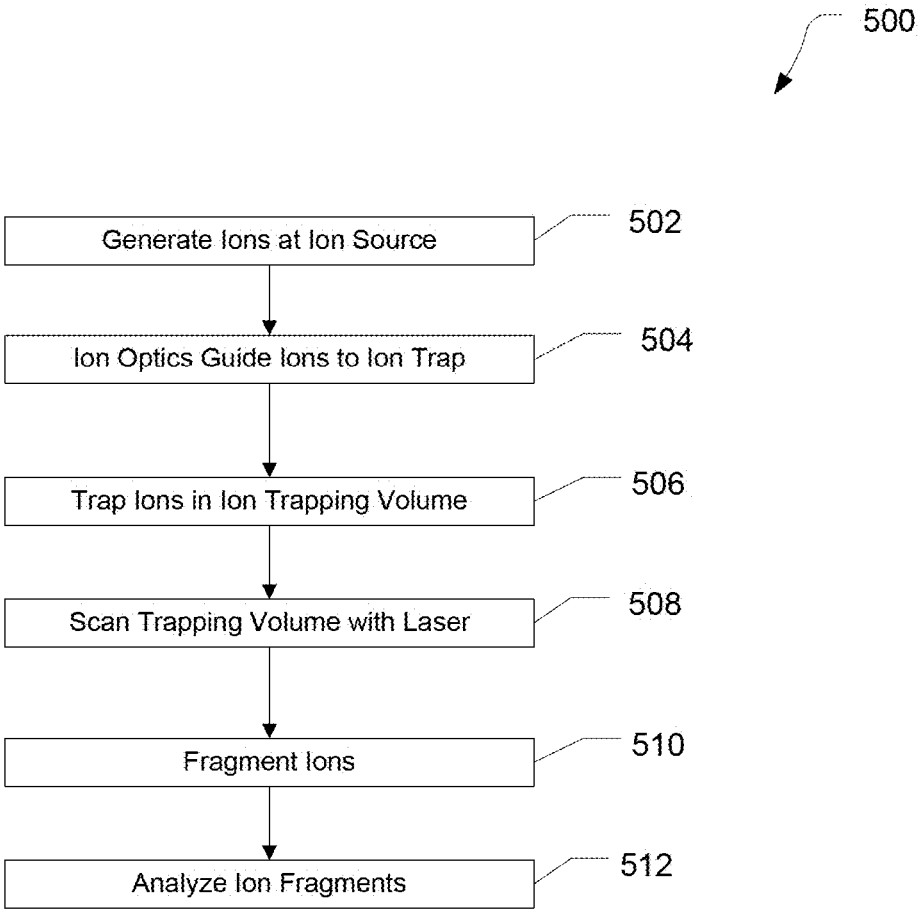
FIG. 5 is a flow diagram illustrating an exemplary method of scanning a laser through an ion trapping volume, in accordance with various embodiments.

FIG. 5 is a flow diagram illustrating an exemplary method 500 of scanning a laser through an ion trapping volume to excite ions within the ion trapping volume which can lead to fragmentation of the ions. At 502, ions can be produced at an ion source, such as ion source 102 of FIG. 1. In various embodiments, the ions can be produced by ionizing a sample, such that compounds in the sample can produce ions representative of the sample compounds. At 504, ions can be guided from the ion source to an ion trap using ion optics, and at 506, the ions can be trapped by the ion trap in an ion trapping volume.

At 508, an area of the trapping volume can be swept with a laser. First and second beam deflectors can cause oscillation of the laser with the first beam deflector causing oscillation in a first direction orthogonal to the beam axis and the second beam deflector causing oscillation in a second direction orthogonal to the beam axis and different from the first direction, such as orthogonal to the first direction. The oscillation in the first direction can be at a first frequency and the oscillation in the second direction can be at a second frequency different than the first frequency.

In various embodiments, the second frequency can be a multiple, such as an integer multiple, of the first frequency. Additionally, the second frequency can be not less than the first frequency times the ratio of the first dimension to a beam width.

In various embodiments, the laser can be a pulsed laser with a pulse frequency higher than the second frequency, such as not less than the second frequency times the ratio of the second dimension to a beam width.

At 510, the laser can interact with the ions in the trapping volume causing at least a portion of them to fragment thereby producing fragment ions within the trapping volume. At 512, the mass-to-charge ratios of the fragment ions can be determined. In various embodiments, the mass-to-charge ratio of the fragment ions can be used to identify and/or quantify the compounds in the sample.

Ion Cloud Selection

In other embodiments, it may be desirable to align the laser to achieve maximum laser-induced signal rather than scanning the ion volume. The laser can be stepped point-by-point through the swept area while the mass spectrometer monitors spectra for laser-induced signal. When a maximum in this signal is found, the beam deflector parameters can be recorded so that the beam deflectors can be returned to the state which resulted in the maximum.

Figure 6:
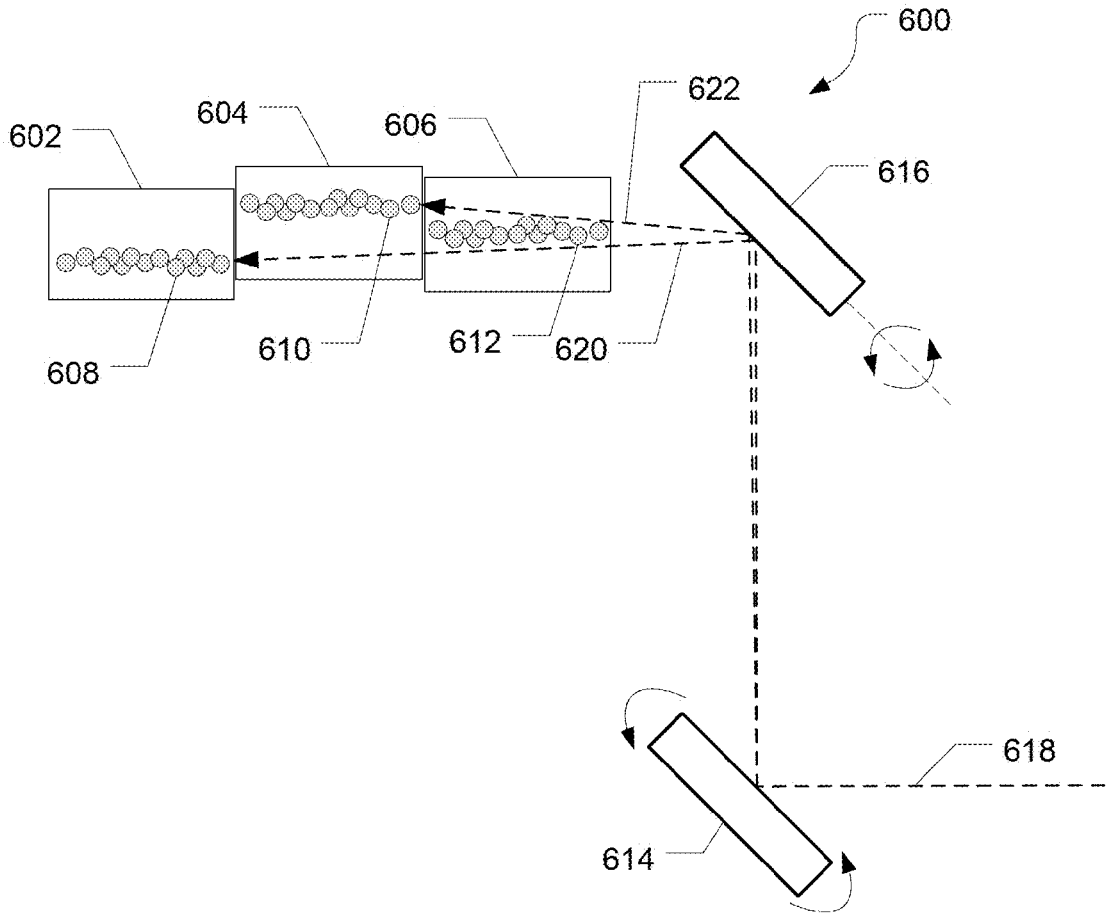
FIG. 6 is a drawing illustrating altering the laser alignment to target other ion clouds trapped within various trapping volumes of an exemplary mass spectrometer, in accordance with various embodiments.

FIG. 6 illustrates an exemplary mass spectrometry system 600 with multiple trapping volumes 602, 604, and 606. At various times, trapping volume 602 can trap ion cloud 608, trapping volume 604 can trap ion cloud 610, and trapping volume 606 can trap ion cloud 612. An ion cloud may only be present in one of trapping volumes 602, 604, 606, rather than having ion clouds simultaneously in multiple trapping volumes. Beam deflectors 614 and 616 can be controlled to direct the laser 618 to a particular one of trapping volumes 602, 604, and 606. For example, in one configuration of the beam deflectors 614 and 616, laser 618 can be directed along path 620 to focus on ion cloud 608 in ion trap 602, while in another configuration, laser 618 can be directed along path 622 to focus on ion cloud 610 in ion trap 604. Using electronically controlled beam deflectors, the laser can be realigned to a different trapping volume during or between experiments without having to manually adjust a series of fixed beam deflectors.

In various embodiments, laser 618 can be independently aligned to each of the ion trapping volumes during an alignment process and the beam deflector parameters can be recorded for each ion trapping volume. Selecting an ion trapping volume can be accomplished by returning the deflectors to the stored configuration for the specified trapping volume.

Figure 7:
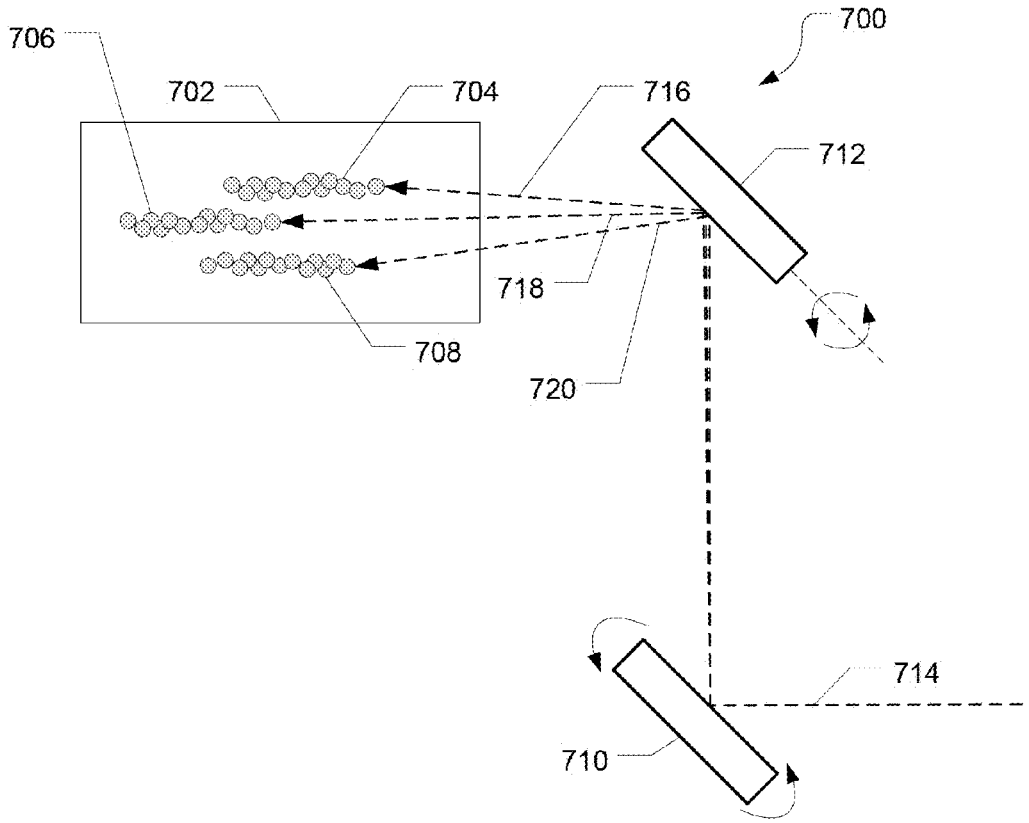
FIG. 7 is a drawing illustrating altering the laser alignment to target other ion clouds trapped within a single trapping volume of an exemplary mass spectrometer, in accordance with various embodiments.

FIG. 7 illustrates an exemplary mass spectrometry system 700 with ion trap 702. At various times, ion trap 702 can trap ion cloud 704, 706, and 708. In various embodiments, only a single ion cloud may be present, or multiple ion clouds may be present simultaneously in different portions of the ion trap. Beam deflectors 710 and 712 can be controlled to direct the laser 714 to a particular one of ion clouds 704, 706, and 708. For example, in one configuration of the beam deflectors 710 and 712, laser 714 can be directed along path 716 to focus on ion cloud 704, while in another configuration, laser 714 can be directed along path 718 to focus on ion cloud 706 in ion trap 704. Similarly, ion a third configuration, laser 714 can be directed along path 720 to focus on ion cloud 708.

Figure 8:
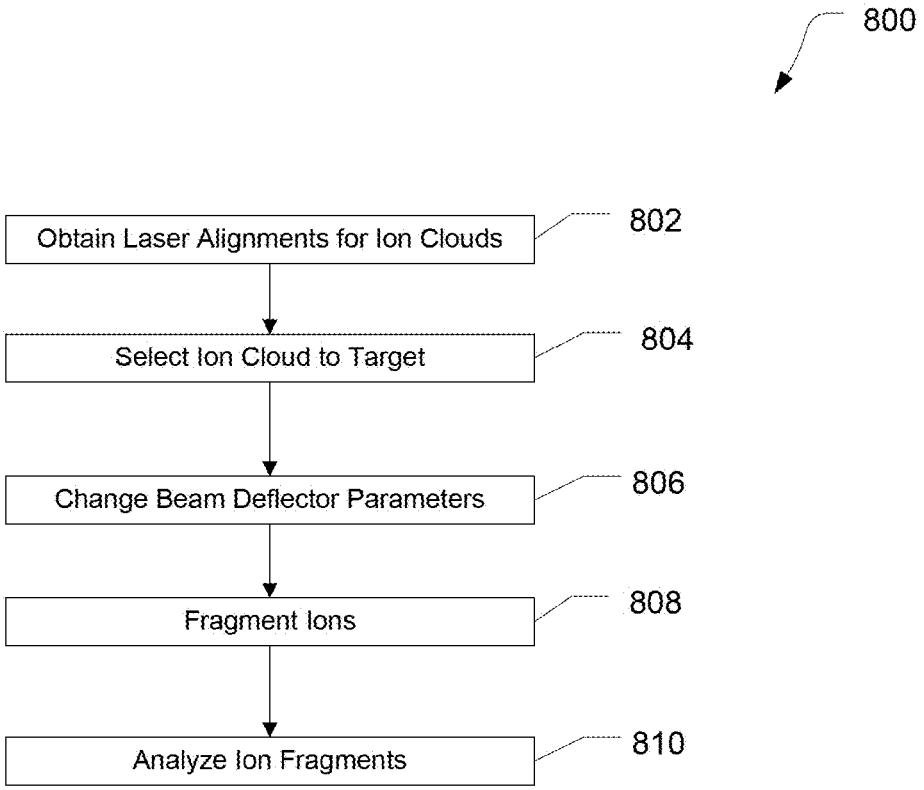
FIG. 8 is a flow diagram illustrating an exemplary method of selectively targeting one of a plurality of ion clouds within an exemplary mass spectrometer, in accordance with various embodiments.

FIG. 8 is a flow diagram illustrating a method 800 of selectively targeting ion clouds. At 802, alignments can be obtained for each ion cloud. The ion clouds may be in different nominally aligned trapping volumes or in different regions of a trapping volume or ion trap. For example, the laser can be scanned through the trapping volume while an ion cloud is present and a laser-induced signal can be monitored to identify the beam deflector parameters that maximize the laser-induced signal. The process can be repeated for each ion cloud of interest. The beam deflector parameters can be stored for each ion cloud location and retrieved as needed. In various embodiments, a calibrant ion or alignment standard can be present in the trapping volume during the alignment to generally align the laser to a trapping volume, or an ion of interest can be used to more specifically align the laser to the location of those ions within the trap.

At 804, an ion cloud location can be selected for targeting, and at 806, the beam deflector configuration can be changed to match the beam deflector parameters identified to align the laser with the selected ion cloud location.

At 808, the laser can irradiate the ion cloud causing the ions to fragment, and at 810, the ion fragments can be analyzed.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass spectrometry system comprising:

a laser source;

a trapping volume;

first and second beam deflectors arranged on a path from the laser source to the trapping volume, the first beam deflector configured to oscillate in a first direction at a first frequency and the second beam deflector configured to oscillate in a second direction orthogonal to the first direction at a second frequency;

a deflector controller configured to:

scan a scanned area within the trapping volume with the laser by controlling the oscillation of the first and second beam deflectors to cause ions trapped within the trapping volume to become excited, the scanned area having a first dimension defined by the oscillation in first direction and a second dimension defined by the oscillation in the second direction.

2. The mass spectrometry system of claim 1 wherein the first and second beam deflectors are mirror galvanometers.

3. The mass spectrometry system of claim 1 wherein the first and second beam deflectors are acousto-optic modulators.

4. The mass spectrometry system of claim 1 wherein the second frequency is a multiple of the first frequency.

5. The mass spectrometry system of claim 4 wherein the multiple is an integer multiple.

6. The mass spectrometry system of claim 4 wherein the second frequency is not less than the first frequency times the ratio of the first dimension to a beam width.

7. The mass spectrometry system of claim 1 wherein the laser source is a pulsed laser source with a pulse frequency higher than the second frequency.

8. The mass spectrometry system of claim 7 wherein, the pulse frequency is not less than the second frequency times the ratio of the second dimension to a beam width.

9. The mass spectrometry system of claim 1 further comprising an ion source for producing the ions, and ion optics for moving the ions from the ion source to the trapping volume.

10. The mass spectrometry system of claim 1 further comprising a mass analyzer configured to determine the mass to charge ratio of the ions.

11. A method of analyzing ion fragments, comprising: trapping ions within a trapping volume; sweeping an area of the trapping volume with a laser by oscillating first and second beam deflectors to excite the ions, the first beam deflector configured to oscillate in a first direction at a first frequency and the second beam deflector configured to oscillate in a second direction orthogonal to the first direction at a second frequency; fragmenting the excited ions within the trapping volume to produce ion fragments; determining a mass-to-charge ratio for the ion fragments.

12. The method of claim 11 wherein the first and second beam deflectors are mirror galvanometers.

13. The method of claim 11 wherein the first and second beam deflectors are acousto-optic modulators.

14. The method of claim 11 wherein the second frequency is a multiple of the first frequency.

15. The method of claim 14 wherein the multiple is an integer multiple.

16. The method of claim 14 wherein the second frequency is not less than the first frequency times the ratio of the first dimension to a beam width.

17. The method of claim 11 wherein the laser is a pulsed laser with a pulse frequency higher than the second frequency.

18. The method of claim 17 wherein the pulse frequency is not less than the second frequency times the ratio of the second dimension to a beam width.

19. The method of claim 11 further comprising producing ions from a sample in an ion source, and guiding the ions from the ion source to the trapping volume using ion optics.

* * * * *